US005929726A

United States Patent [19]

Ito et al.

[11] Patent Number: 5,929,726

[45] Date of Patent: Jul. 27, 1999

[54] DIELECTRIC FILTER DEVICE

[75] Inventors: Kenji Ito; Seigo Hino, both of Nagoya, Japan

[73] Assignee: NGK Spark Plug Co., Ltd., Aichi-ken, Japan

[21] Appl. No.: 08/816,690

[22] Filed: Mar. 13, 1997

Related U.S. Application Data

[63] Continuation of application No. 08/421,161, Apr. 10, 1995, abandoned.

[30] Foreign Application Priority Data

Apr. 11, 1994 [JP] Japan ..... 6-072233

[51] Int. Cl.[6] ..... H01P 1/205

[52] U.S. Cl. ..... 333/206; 333/207

[58] Field of Search ..... 333/202, 203, 333/206, 207, 222, 223

[56] References Cited

U.S. PATENT DOCUMENTS

| | | | |
|---|---|---|---|
| 4,431,977 | 2/1984 | Sokola et al. | 333/202 X |
| 4,523,162 | 6/1985 | Johnson | 333/204 X |
| 4,937,542 | 6/1990 | Nakatuka | 333/202 |
| 4,985,690 | 1/1991 | Eguchi et al. | 333/206 X |
| 5,208,565 | 5/1993 | Sogo et al. | 333/206 |
| 5,327,108 | 7/1994 | Hoang et al. | 333/203 |
| 5,436,602 | 7/1995 | McVeety et al. | 333/206 |
| 5,499,004 | 3/1996 | Noguchi et al. | 333/206 X |

FOREIGN PATENT DOCUMENTS

| | | | |
|---|---|---|---|
| 0038601 | 2/1987 | Japan | 333/202 |
| 43904 | 2/1987 | Japan | 333/202 DB |
| 0187901 | 8/1988 | Japan | 333/202 |
| 0278401 | 11/1988 | Japan | 333/202 |
| 5-167310 | 7/1993 | Japan | 333/202 |
| 6090104 | 3/1994 | Japan | 333/206 |

*Primary Examiner*—Seungsook Ham
*Attorney, Agent, or Firm*—Larson & Taylor

[57] ABSTRACT

A dielectric filter device whose input and output coupling capacities can be regulated by modifying the diameters of the open end portions of laterally arranged resonance bores disposed adjacent respective input/output terminals so that any standardized printed circuit board may be used with it without altering the dimensions of the input and output terminals and hence the production control procedures for manufacturing such printed circuit boards may be simplified. The diameters of the open end portions of the laterally arranged resonance bores of the device located adjacent the respective input and output terminals are modified to alter the surface areas of the corresponding inner conductors arranged therein.

1 Claim, 3 Drawing Sheets

DIELECTRIC FILTER DEVICE

This application is a continuation of application Ser. No. 08/421,161 filed Apr. 10, 1995 now abandoned.

BACKGROUND OF THE INVENTION

The present invention relates to a dielectric filter device to be suitably used for telecommunications equipment such as a portable telephone set or a mobile telephone set.

To meet the demand for reducing the size and weight of telecommunications equipment including portable and mobile telephone sets, efforts have been made to produce miniaturized and flat dielectric filter devices to be used for such applications. Such devices are mostly so arranged that they can be directly mounted on printed circuit boards.

FIGS. 1 and 2 of the accompanying drawings illustrate a conventional tripolar interdigital type dielectric filter device which comprises a dielectric ceramic main body A having a substantially rectangular parallelepipedic profile and provided with three through bores B1, B2 and B3 running therethrough between a pair of oppositely disposed sides of the main body A. The through bores B1, B2 and B3 are provided with respective inner conductors C1, C2 and C3 on the peripheral surfaces thereof. The dielectric ceramic main body A has an outer surface portion carrying an outer conductor D. Further, the dielectric ceramic main body A has end surface portions (of which only one is shown in FIGS. 1 and 2 and indicated by E) as short circuiting surfaces each surrounding one of the the openings of each of the through bores C1, C2 and provided with a conductor layer for electrically connecting one end of each of the inner conductors C1, C2 and C3 with the outer conductor D. The other end surface portions (of which two are shown in FIGS. 1 and 2 and indicated by F) has open circuiting surfaces each surrounding the other of the openings of each of the through bores C1, C2 and C3 and provided with no conductor layer for electrically disconnecting the other end of each of the inner conductors C1, C2 and C3. The short circuiting and open circuiting surface portions are arranged in an interdigital manner. Input and output terminals G and H are arranged on the bottom of the dielectric ceramic main body A at locations adjacent the respective lateral inner conductors C1 and C3 and near the respective open surface portions F adjacent to the inner conductors C1 and C3. Finally, slits or grooves I1, I2, I3, and I4 are arranged on the top and the bottom of the dielectric ceramic main body A for interstage coupling in such a way that they run in parallel with each other and with the through bores, each being located between two adjacent through bores, so that they may regulate the degree of interstage coupling of the inner conductors that operate as a resonator.

The conventional dielectric filter device having a configuration as described above is then directly mounted on a printed circuit board by soldering the input and output terminals G and H to given input and output circuits provided on the printed circuit board.

With the conventional dielectric filter device as described above, desired input and output coupling capacities can be achieved for the device only by appropriately modifying the surface areas of the input and output terminals G and H. More specifically, as shown in FIG. 1 input and output terminals G and H having a large surface area are used if large input and output coupling capacities are required, whereas as shown in FIG. 2 input and output terminals G and H having a small surface area are used if small input and output capacities are required.

On the other hand, there are a number of electronic components, besides a dielectric filter device, that are to be mounted on a single printed circuit board. This means that only a limited area can be allocated to a dielectric filter device on a printed circuit board and the input and output circuits of the printed circuit board are dimensionally adjustable only within a narrow limit to meet the dimensional requirements of the input and output terminals of a dielectric filter device so that the input and output circuits of a printed circuit board have to be, more often than not, modified in a cumbersome way to meet the specific dimensional requirements of the input and output terminals of a dielectric filter device to be mounted thereon, providing an obstacle to efficient mass production of printed circuit boards. In other words, since dielectric filter devices have differently sized input/output terminals depending on the required input and output coupling capacities, printed circuit boards have to be provided with differently sized input and output circuits to accommodate the difference in the size of the input and output terminals of dielectric filter devices rise to cumbersome production control procedures.

In view of the above identified problem, it is therefore the object of the present invention to provide a dielectric filter device having input and output coupling capacities that are adjustable without modifying the profile and size of the input and output terminals.

SUMMARY OF THE INVENTION

According to the invention, there is provided a dielectric filter device comprising a dielectric ceramic body provided with a plurality of through bores extending between front and rear sides thereof, each through bore having a peripheral surface provided with an inner conductor, the dielectric ceramic body having an outer surface portion provided with outer conductor, and an input and output terminals arranged adjacent the respective inner conductors of the lateral sides of the through bores to form input and output coupling capacities therebetween, the input and output terminals being suitable to be directly connected to the corresponding input and output circuits of a printed circuit board, wherein the diameter of each of the through bores at a portion close to the open surface layer thereof is regulated to vary the surface area of the inner conductor of the through bore thereby controlling the input and output coupling capacities.

For the purpose of the invention, the dielectric ceramic body may be further provided with a plurality of grooves arranged in parallel with the through bores on at least a side thereof for providing interstage couplings.

For the purpose of the invention, the through bores in the dielectric ceramic body may be expanded at and near the open ends thereof located adjacent the respective input and output terminals.

One end of each of the respective inner conductors is connected to the outer conductor via a short-circuiting conductor to form a short-circuiting end and the short-circuiting ends of the respective inner conductors may be interdigitally arranged.

With a dielectric filter device according to the invention and having a configuration as described above, the input and output coupling capacities of the device can be controlled by regulating the diameter of each of the through bores at a portion close to the open surface layer thereof and hence the surface area of the inner conductor of the through bore so that the input and output terminals of such a device can always be made to have same and identical dimensions regardless of the input and output coupling capacities of the device. With such an arrangement, the input and output terminals of the device can be easily aligned with the corresponding input and output circuits of a printed circuit board onto which the device is to be mounted so that dielectric filter devices having different input and output coupling capacities can be mounted on standardized printed circuit boards without dimensionally modifying the input and output circuits of the latter to remarkably simplify the production control procedures for the manufacture of printed circuit boards of the type under consideration.

Now, the present invention will be described in greater detail by way of a preferred embodiment of the invention illustrated in the accompanying drawings.

DETAILED DESCRIPTION OF THE PREFERRED EMBODIMENT

Figure 1:
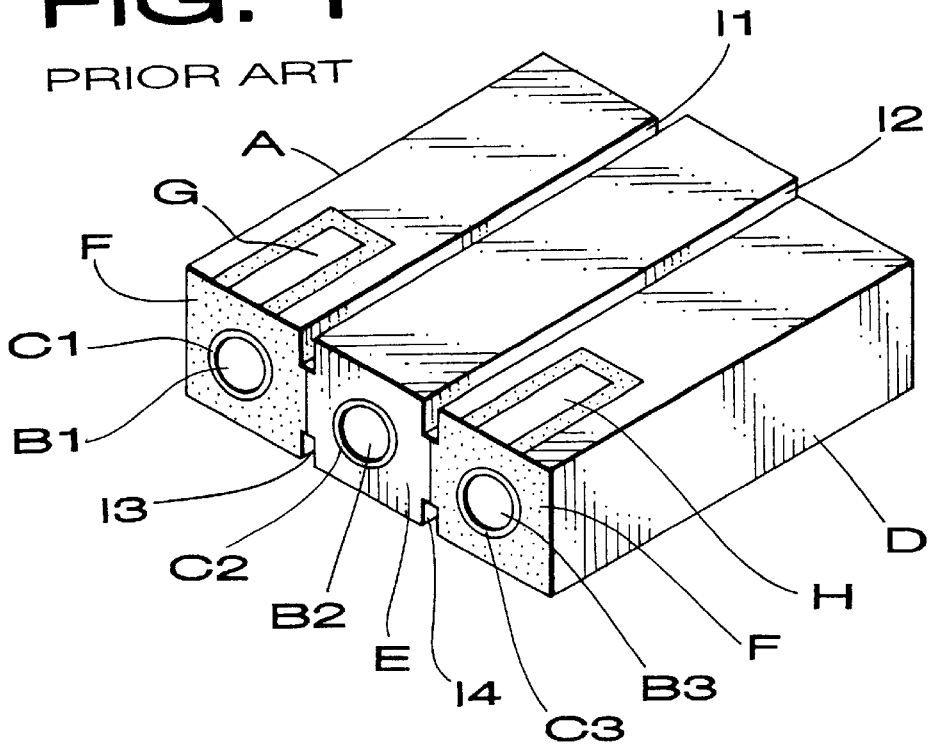
FIG. 1 PRIOR ART
FIG. 1 is a schematic perspective view of a conventional tripolar interdigital type dielectric filter device.
Figure 2:
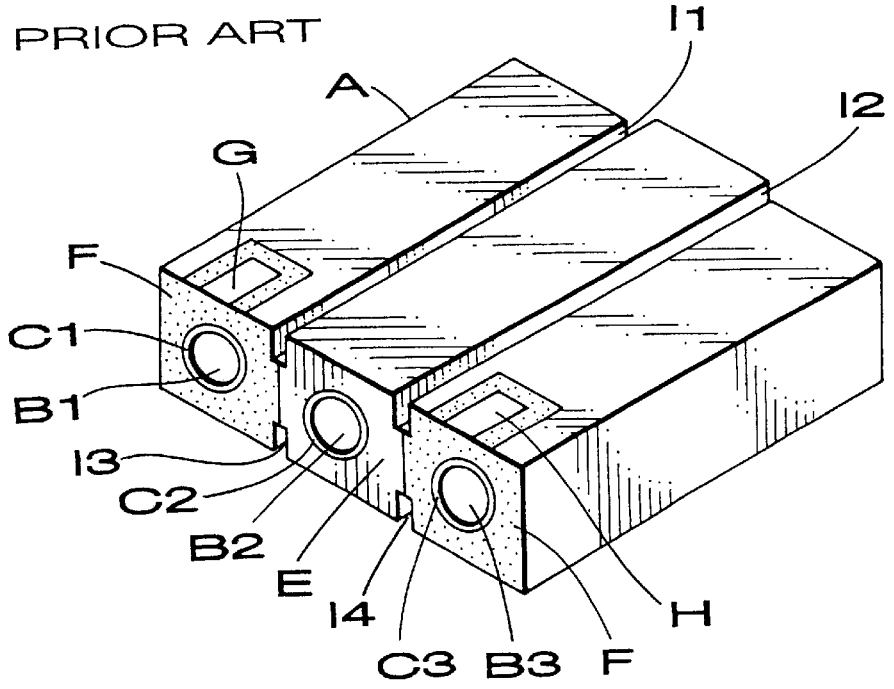
FIG. 2 PRIOR ART
FIG. 2 is another schematic perspective view of the conventional dielectric filter device of FIG. 1, showing a state where its input and output coupling capacities are modified.
Figure 3:
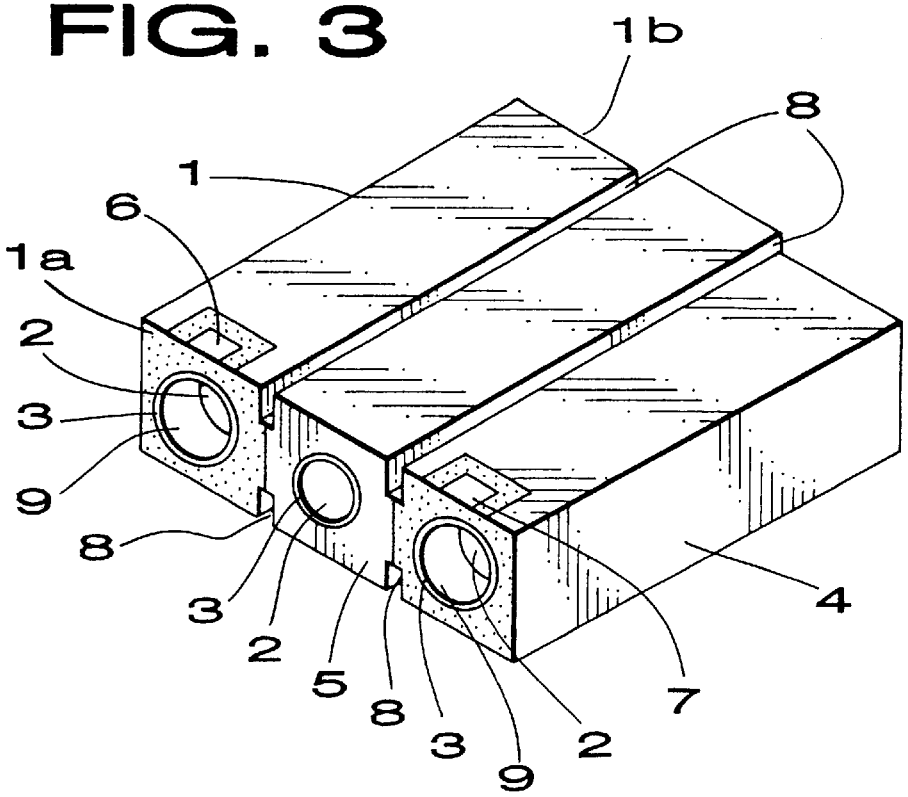
FIG. 3 is a schematic perspective view of a preferred embodiment of dielectric filter device according to the invention.
Figure 4:
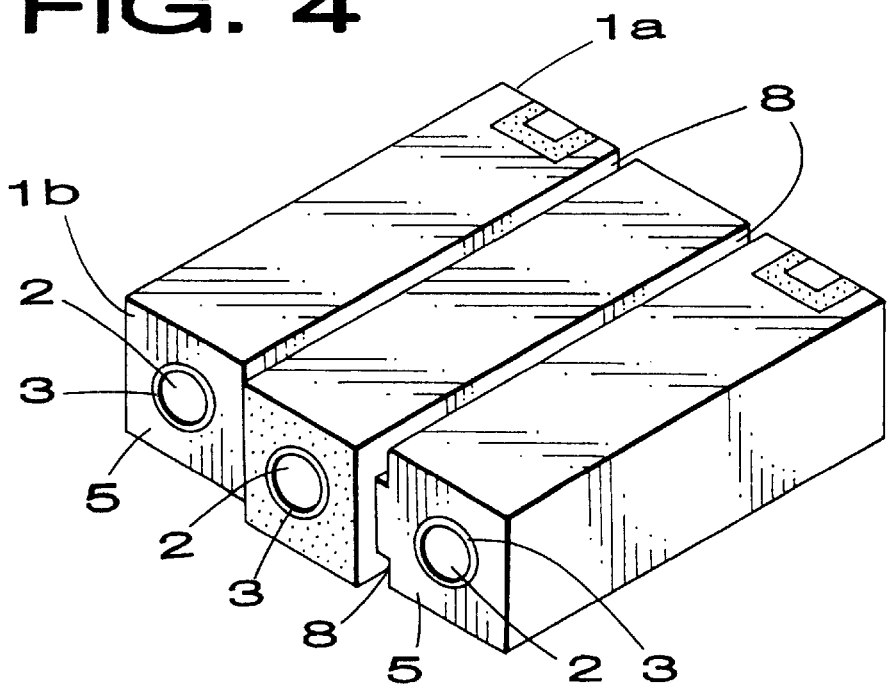
FIG. 4 is a schematic perspective view of the embodiment of FIG. 3 as viewed from the opposite side.
Figure 5:
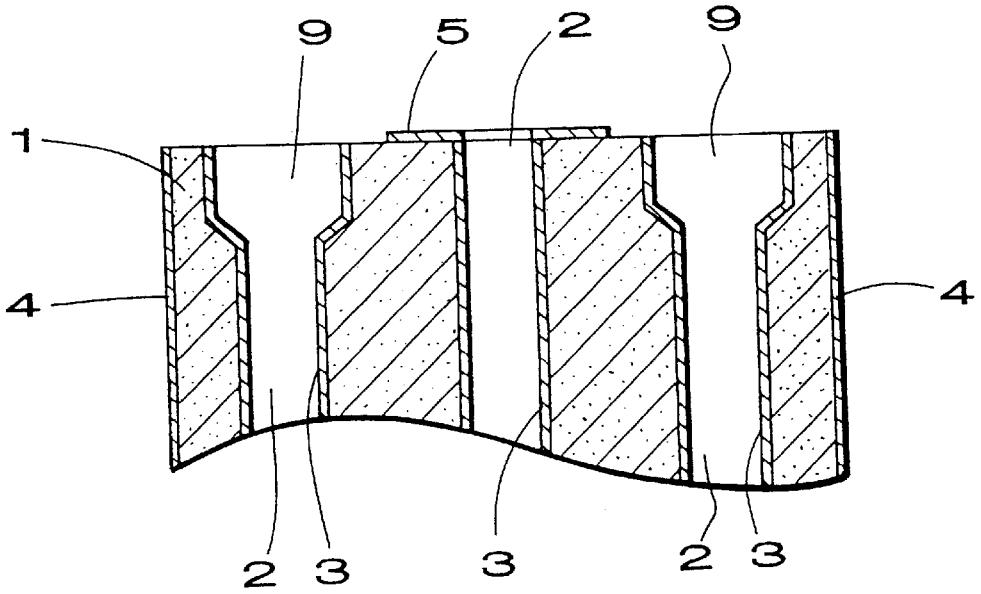
FIG. 5 is a schematic longitudinal cross sectional view of the embodiment of FIG. 3, showing a state where it is regulated to show an increased input and output coupling capacities.
Figure 6:
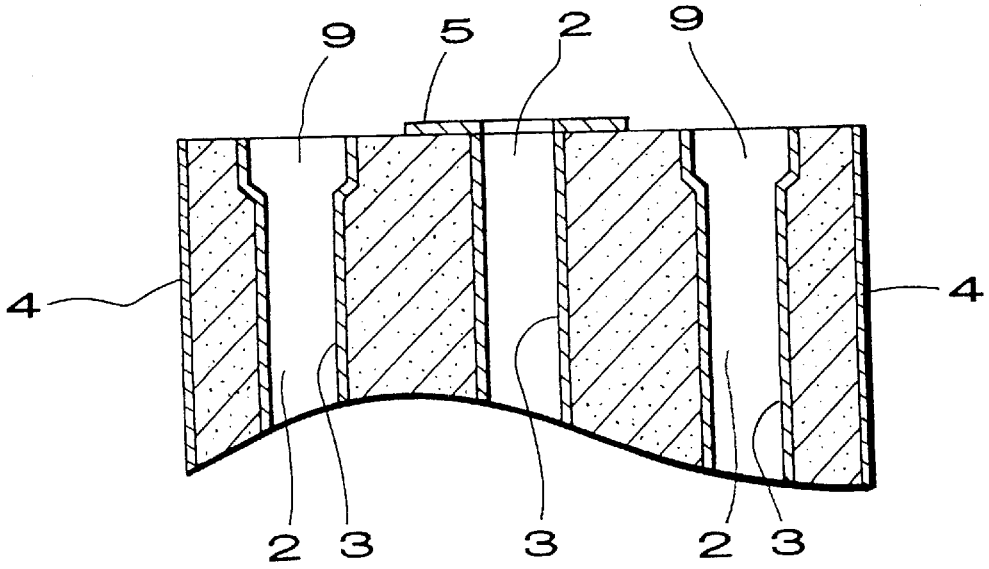
FIG. 6 is a schematic longitudinal cross sectional view of the embodiment of FIG. 3, showing a state where it is regulated to show a reduced input and output coupling capacities.

A preferred embodiment of the invention will be described below by referring to FIGS. 3 through 6 of the accompanying drawings.

Referring variously to FIGS. 3 through 6, a tripolar interdigital type dielectric filter device according to the invention comprises a rectangular parallelepipedic dielectric ceramic body 1 (shown in FIGS. 3 and 5) provided with three through bores or resonant bores 2 running through the body between the front end side 1*a* (FIGS. 3 and 4) and the rear end side 1*b* (shown in FIGS. 3 and 4), each of said resonant bores 2 being provided on the peripheral surface thereof with a resonant conductor 3. The dielectric ceramic body 1 is covered by an outer conductor 4 (FIGS. 3, 5 and 6) except the front and rear end sides, the conductor 4 operating as a grounding conductor.

Short circuiting surface layers 5 are formed on the front and rear end surfaces 1*a* and 1*b* of the dielectric ceramic body 1 to electrically connect one end of each of the resonance conductors 3 with the outer conductor 4. Open surface layers are formed on the remaining areas of the front and rear end surfaces la and lb to insulate the other end of each of the resonance conductors 3 from the outer conductor 4. It will be seen from FIGS. 3 through 6 that the short circuiting surface layers are arranged in a zigzag manner to form a tripolar interdigital type filter.

The dielectric ceramic body 1 is also provided with input and output terminals 6 and 7 (FIG. 3) arranged on the bottom of dielectric ceramic body 1. Below the respective resonance bores 2 at locations close to the respective open surface layers thereof, the input and output terminals 6 and 7 being sized to predetermined dimensions. The dielectric ceramic body 1 is further provided with slits or grooves 8 (FIGS. 3 and 4) arranged on the top and the bottom of the dielectric ceramic body 1 for interstage coupling in such a way that they run in parallel with each other and with the through bores, each being located between two adjacent through bores, so that they may regulate the degree of interstage coupling of the inner conductors that operate as a resonator.

The resonance bores 2 of the dielectric ceramic body 1 are expanded at portions close to the respective open surface layers as indicated by reference numeral 9 (FIGS. 3, 5 and 6) to increase the area of the resonance conductors 3 therein so that the input and output coupling capacities of the device may be regulated. The input and output coupling capacities of the device can be increased by selecting a large diameter and a large depth for the expanded portions 9 of the resonance bores 2, whereas the capacities can be reduced by selecting a small diameter and a small depth for the expanded portions 9.

A dielectric filter device having a configuration as described above is then directly mounted on a printed circuit board (not shown) by soldering the input and output terminals 6 and 7 to given input and output circuits of the printed circuit board. Since the input and output terminals 6 and 7 of such a device remain dimensionally the same and identical, if the input and output coupling capacities of the device are altered so that the device can be fitted to any standardized printed circuit board, the operation of aligning and mounting the device can be carried out with ease.

While the present invention is described and illustrated in terms of a tripolar interdigital type dielectric filter device, the number of resonance bores of a dielectric filter device according to the invention is not limited to three and any number of resonance bores equal to or greater than two may be used for the purpose of the invention. A combline type dielectric filter device having short circuiting surface layers only on a single end surface of the dielectric ceramic body to short circuit an end of each of the resonance conductors arranged on the peripheral surfaces of resonance bores and the outer conductor may alternatively be used.

While the dielectric ceramic body is provided on both the top and bottom with grooves for interstage coupling in the above embodiment, such grooves may alternatively be arranged only on the top or the bottom of the body. Still alternatively, a dielectric ceramic body without such groove may be used. The cross section of each of the grooves may have any appropriate profile.

As described above in detail, since a dielectric filter device according to the invention is provided with lateral through bores arranged adjacent the input and output terminals, in that the bores are inside the device and the terminals are outside of the device and the bores are capable of being regulated for the diameter at the respective ends close to the open surface layers to alter the surfaces areas of the respective inner conductors, the input and output terminals can dimensionally remain constant regardless of the input and output coupling capacities of the device so that the device can be aligned with and mounted on a standardized printed circuit board without difficulty. Therefore the design and the production control procedures for the manufacture of printed circuit boards of the type under consideration can be remarkably simplified.

We claim:

1. A dielectric filter device comprising:

a unitary dielectric ceramic body having a parallelepiped shape and thereby including a front side, a rear side, a right side, a left side, a top side, and a planar bottom side;

a plurality of parallel circular through bores provided in a row in said ceramic body extending from the front side to the rear side such that there is at least a first outermost through bore adjacent said right side and a second outermost through bore adjacent said left side, each said through bore including a peripheral surface;

a respective inner conductor layer provided from said front side to said rear side on each said peripheral surface of each said through bore;

an outer conductor layer provided on a majority portion of an outer surface of said ceramic body excluding a first planar surface portion on said planar bottom side adjacent said first outermost through bore and a second planar surface portion on said planar bottom side adjacent said second outermost through bore;

an input terminal layer and an output terminal layer respectively provided on said first surface portion and said second surface portion of said planar bottom side of said outer surface such that respective input and output coupling capacities are created between respective said input and output terminal layers and respective said first and second surface portions and such that said input and output terminal layers are directly connected to associated input and output circuits of a printed circuit board, each of said input and output terminal layers having a predetermined size determined by the corresponding predetermined input and output circuits of a printed circuit board to which said input and output terminal layers are adapted to be aligned during use; and respective first and second circular opening end portions of respective said first and second outermost through bores which extend inwardly from said front side, each said opening end portion having an inner diameter greater than an inner diameter of a remainder of an associated said outermost through bore and extending inwardly from said front surface to a selected depth such that predetermined values of the input and output coupling capacities are produced as desired by varying the selected depth and without varying the predetermined size of said input and output terminal layers;

a respective groove provided in at least one of said top side or said bottom side between adjacent said through bores and parallel thereto, for providing interstate couplings between the adjacent said through bores; and a respective short-circuiting conductor which respectively connects one end of each of the respective said inner conductors to said outer conductor to define a respective short-circuiting end, said short-circuiting ends being interdigitally arranged.

* * * * *